United States Patent [19]

Perez

[11] Patent Number: 4,616,373

[45] Date of Patent: Oct. 14, 1986

[54] LOADING AND UNLOADING RAMP UNIT FOR RAILWAY CONVOY TRAIN

[75] Inventor: Juan J. B. Perez, Madrid, Spain

[73] Assignee: Jefatura de Ingenieros del Ejercito, Madrid, Spain

[21] Appl. No.: 556,543

[22] Filed: Nov. 30, 1983

[30] Foreign Application Priority Data

Nov. 30, 1982 [ES] Spain ..... 517.837

[51] Int. Cl.[4] ..... E01D 1/00; E01D 15/12

[52] U.S. Cl. ..... 14/72.5; 14/71.1; 414/522; 414/537

[58] Field of Search ..... 14/69.5, 71.1, 71.3, 14/71.7, 72.5; 414/522, 537, 538; 410/1–3, 6, 56; 119/82; 182/131

[56] References Cited

U.S. PATENT DOCUMENTS

| | | | |
|---|---|---|---|
| 1,271,812 | 7/1919 | Wagner | 410/1 |
| 2,678,139 | 5/1954 | Gildersleeve | 414/522 |
| 3,153,489 | 10/1964 | Leavengood et al. | 414/537 |
| 3,438,519 | 4/1969 | Willis | 414/522 X |
| 3,485,400 | 12/1969 | Pewthers | 414/522 X |
| 3,916,799 | 11/1975 | Smith | 410/1 |
| 4,076,134 | 2/1978 | Landow | 14/69.5 X |
| 4,129,079 | 12/1978 | Shannon | 410/1 |
| 4,235,399 | 11/1980 | Shorey | 14/72.5 X |
| 4,268,209 | 5/1981 | Westerman | 410/6 X |
| 4,373,857 | 2/1983 | Giles | 410/6 X |

FOREIGN PATENT DOCUMENTS

| | | | |
|---|---|---|---|
| 211981 | 7/1956 | Australia | 410/3 |

*Primary Examiner*—Stephen J. Novosad
*Assistant Examiner*—Matthew Smith
*Attorney, Agent, or Firm*—Dennison, Meserole, Pollack & Scheiner

[57] ABSTRACT

A loading unit is mounted on a railway flat car to load and unload heavy wheeled, tracked or towable vehicles at any desired point along the railway right-of-way. The ramp unit enables vehicles to be loaded and unloaded one after the other along apron extensions disposed obliquely. The track, ties and ballast areas are protected by the ramp unit against disturbance or damage during the loading or unloading operations. A base portion is mounted on a flat car and is generally stationary relative thereto. Ramp, platform and apron portions are mounted thereon and are generally longitudinally movable relative to the base and define, in turn, a load path sloped to the railway bed from the flat car surface. The platform portion is adapted to overlie and protect the railway tracks, ties and bed during loading and unloading of the train and provides angulated apron segments enabling vehicles to be loaded and unloaded without damaging the railway tracks, ties or ballast.

7 Claims, 20 Drawing Figures

LOADING AND UNLOADING RAMP UNIT FOR RAILWAY CONVOY TRAIN

FIELD OF THE INVENTION

This invention relates to a loading and unloading ramp unit for enabling loading and unloading of diverse types of vehicles on and off of railroad flat cars, without damage to the track, ties, or ballast, or making conditioning or preparatory work necessary.

More particularly, the present invention finds particular utility when applied to military type convoy trains in that it enables loading and unloading thereof by, motorozied weapons, tanks, and the like, at any point along the railroad right-of-way, without regard to fixed loading and unloading facililties, platforms, or the like, and. without alteration of the convoy vehicular sequence. Although particularly adapted to the movement of military convoys, the advantages of the present invention also find civil utility in enabling, for example, unloading of farm equipment, or the like, at diverse rural locations.

BACKGROUND OF THE INVENTION

Previous systems used for loading and unloading self-propelled heavy material such as self-propelled personnel carriers, weapons systems, tanks and other allied military vehicles, as well as civil vehicles such as farm equipment, and the like, have heretofore generally always been carried out on station platforms or work platforms manufactured or installed especially for this purpose. However, such limited and generally very localized positions of such stationary platforms have generally limited the use of military convoys or civil transport of heavy materials such as farm equipment to movement between locations equipped with such fixed platforms or access locations and has, accordingly, severely limited rail transportation of both military and civil vehicles freely to strategic points.

The invention is especially adapted to enable loading or unloading of self-propelled military equipment but it can also be used for other purposes such as the loading or unloading of public works machinery, water works machinery, farm machinery, construction machinery, and any other activity that requires the use of self-propelled heavy machinery. Any of these vehicles will therefore be able to be loaded and/or unloaded on the open tract, in other words, on any point of the railway line that contains a span with the dimensions necessary for extending, spreading out, and dropping the platform or ramp unit sections incorporated as parts of the present invention and no special loading or unloading docks, compounds, stations, permanent platforms, or the like, specially constructed, or fixed facilities are required.

BRIEF DESCRIPTION OF THE INVENTION

In accordance with the present invention a loading and unloading ramp unit is mounted with a railway flat car enabling the loading or unloading of one or more vehicles, such as self-propelled weapons, personnel carries, other military equipment, or civilian equipment, such as public works, farm machinery, construction machinery, and the like, providing a ramp for loading and unloading such vehicles on and off a train while protecting the track, ties and ballast from damage or displacement thereby, and enabling loading or unloading at sustantially any desired location along the track when the track extends generally straight and without excessive slope to the side access or accesses.

In accordance with the present invention there is provided a loading and unloading ramp unit adapted to be secured with a railway flat car to enable loading and unloading of self-propelled heavy material and comprising a first generally stationary flat platform portion provided with a double set of parallel longitudianl guides, a second or middle generally flat platform portion that slides, extends out, and tilts downwardly in the form of a ramp, hinged in the front and equipped with a body including a head end portion carrying: hydraulic driving apparatus; towing and sliding; and hydraulic distribution valving apparatus; support and guiding apparatus operative during extension and retraction thereof; auxiliary loading and unloading support apparatus; a third generally flat platform portion comprising a protective platform portion for covering and protecting the rails, ties and ballast; apparatus for letting said third protecting platform portion loose to slide downwardly generally off said second platform portion and for recovering such generally flat protective platform portion to be selectively superposed upon said second or middle flat portion and apparatus for hauling back in said protective third generally flat platform portion; said third or protective platform portion being thereby selectively superposed upon said second platform portion and being generally shorter than said second platform portion and in turn being provided with: simple sliding appartus; collapsible apparatus for running over the railway track; apparatus for anchoring it and retaining it on such railway rails, and side and end access and descent ramps for access and descent of, for example, self-propelled heavy material and apparatus for collapsing or raising said side and end access and descent ramps; and a hydraulic circuit to feed and drive the entire hydraulic unit from said distribution or valving means mounted on said head of said second or middle flat platform portion.

IN THE DRAWINGS

DETAILED DESCRIPTION OF THE INVENTION

Figure 1:
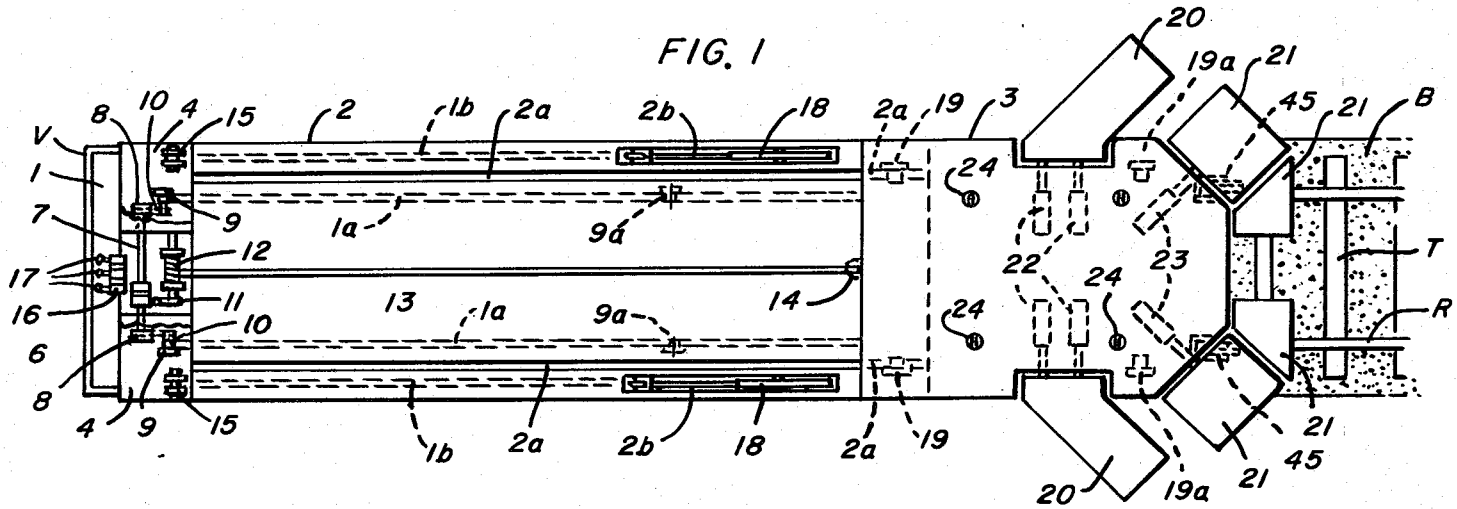
FIG. 1 is a plan view of the platform unfolded or spread out with a schematic representation of its mechanical and complementary means.

The ramp unit comprises a combination of elements which provide the train with an access ramp generally following along the longitudinal center line of the train and tracks and extending generally laterally thereof upon which all types of self-propelled towed, or pushed vehicles or equipment zcan run without damage or modification to the tracks, ties, or ballast. The ramp unit is mounted on a railroad flat car directly, without requiring any changes or modifications to the basic flat car. The ramp unit need not remain associated, however, with any specific flat car and may be moved as needed from car to car.

In accordance with the present invention a buffer platform or ramp unit is mounted on and transportable with a railway flat car for movement preferably as the first or last car in a railway convoy of vehicles. Vehicles may be loaded on such train convoy along any track span that has a straight section of at least approximately 35 meters and with relatively gentle side accesses. The ramp unit that is the object of the present invention has a maximum slope no greater than approximately 16% so that a tank or other vehicle does not tilt excessively when it is loaded or unloaded. The interaction of the platform or ramp unit with the track is such that it does not damage either the rail, the ties, or the ballast and is such that a relatively smooth surface is provided for the loading or unloading of vehicles, and the like.

Another aspect of the present invention is that the ramp unit includes access ramp sections for self-propelled vehicles such as tanks designed in order to avoid any need for abrupt maneuvers and/or changes of direction greater than about 45° during the loading and unloading. In accordance with the present invention the platform or ramp unit may be transportable along the track in the same portion of a convoy train that transports the tanks or vehicles. The ramp of the present invention is preferably mounted to a flat car located at the front or rear section of the convoy and, once mounted in such position, it does not interrupt the passage of the armored, mechanized or motorized column because it may be loaded in sequence onto or off of the train. While the invention is especially adapted to load or unload self-propelled military equipment, it can also be used for other purposes such as the loading and unloading of public works machinery, water works machinery, farm machinery, construction machinery, and any other activity that requires the use of self-propelled heavy machinery. Any of these vehicles will therefore be able to be loaded or unloaded on the open track, in other words, on any point of the railway line that contains a span with the dimensions necessary for extending, i.e., spreading out and dropping, the various sections or portions of the platform or ramp unit which is the subject of the present invention and no special loading docks, compounds, stations, fixed platforms, or other specially constructed fixed facilities are required.

In accordance with the present invention the loading or unloading platform, buffer or ramp unit, comprises:

(1) A carrying stationary generally flat first platform portion that is superposed upon the railway flat car, avoiding any need for modification of such flat car and which comprises anchorage elements needed to fasten the same, as well as a set of guides for the running or sliding of a second or middle generally flat platform portion, which, in turn, is superposed upon the first or stationary flat platform portion. The term "stationary" is used herein to indicate that the first platform portion is generally fixed to or stationary relative the flat car, with the other portions of the ramp unit being moveable relative thereto.

(2) A second or middle generally flat platform portion movably carried on the stationary portion and, when extended, defining a generally inclined ramp from generally adjacent the railway track to the stationary or first platform portion at the flat car bed height and comprises means for access or descent of the transported self-propelled vehicles or other loads and provided with running elements necessary in order to enable it to slide longitudinally along the stationary flat platform portion and to be tilted relative thereto so that it can be put in place as a ramp. The second or middle platform portion comprises, in turn:

(a) Tractioned and/or self-contained driving element running elements built in the head of the middle platform portion.

(b) Another set of loose running or free rolling elements to stabilize and guide said middle platform portion.

(c) A set of little rollers mounted sideways of and parallel to the front ones that have a run limited by some special guides or stops provided on the stationary platform portion and that are parallel, on the outside, to the running guides of the wheels for the sliding of the middle platform portion.

(d) A self-contained driving element or engine which, in turn, hydraulically or directly drives a winch anchored to the middle flat wagon in order to release or recover a third or protective platform portion that will be described further on.

(e) A distributor or valve unit, preferably a hydraulic one, that coordinates a battery of hydraulic cylinders in order to be able to maneuver certain parts of said platform portion.

(f) Some skids retractable into the frame of this third or protective platform portion, which are extendable vertically in order to rest on the rails; which are hinged in both grooves and they can be dropped or spread out by hand and which are preferably telescopic, and at the point that rests on the rail, they are both provided with wheels that may slide upon them.

(g) Some props or middle stays, likewise retractable that have a dimension shorter than the height between their fastening points and the rails in order to give way with the weight of the load and to rest on the latter.

(h) A head end portion made up of two wedge shaped sections separated laterally from each other and respectively hinged to the main body of the second or middle platform portion, upon which they tilt forming a ramp. The wedge sections remain anchored upon the stationary platform portion by means of the stop, at the limit of their runs, of the little rollers described in (c).

(i) a free end which is also wedge-shaped for coupling the protection platform portion, that will be described later on.

(3) A third or protective platform portion for protecting the track, ties, and ballast, and which like the two other ones is superposed on them in a state of rest or for transportion and that is prepared to be fastened to the track and provided with collapsible fenders or access and descent ramp extensions in order to cover both sides and the top of the ties, ballast and track for a distance that allows for the loading and unloading of vehicles. This protection platform portion selectively extends from or is superposed upon the middle platform portion and along with the latter it may in turn placed upon the stationary platform portion of the ramp unit. The operation is carried out by means of hydraulic means foreseen in (e) but it can also be done by hand. The third or protection platform portion comprises in its turn:

(a) Two side fenders or access and descent ramp sections mounted on openings made in this platform portion and hinged against hinges welded to the same, pivoted on their ends and equipped in the line of articulation of hydraulic pistons in order to collapse them or to raise them. They have the shape of a parallelogram and, when collapsed they form side ramps facing sidewards and backwards.

(b) Another two pointed end fenders or access or descent ramp sections mounted upon the beveled edges of the free corners of this protective platform portion, hinged against hinges welded to the same and equipped in the line of articulation with a single hydraulic piston in each one. They have a combined trapezoidal-quadrangular shape and, when collapsed they form ramps that are adjacent and lined up in the front with the railroad line. These fenders form access ramps with a slight difference of level, that cover and protect the ballast, the ties and the rails in loading and unloading operations.

(c) A set of collapsible grooved wheels; mounted on the front edge of this platform portion below the front fenders that are positioned in order to run over the rail when the ramp unit spreads out and they collapse when it is telescoped or contracted for travel or storage.

(d) Jacks in order to fasten this protective platform portion to the rails in the loading and unloading operations and that are operated by hand by means of a simple lever and they anchor against the rail by means of an excentric bed-plate that, on the one side is cut off and on the other side mates against the inside flange or section of the rail, in such a way that, by turning it a fourth of a turn, it moves between anchored and unanchored positions.

(e) At least one set of loose or freely rotatable wheels in order to facilitate their sliding upon the middle platform portion and, mainly during the initial towing of this protection platform portion in the contraction or telescoping operation of the platform.

A broader idea of the features of the invention follows upon making reference to a sheet of drawings that is appended to this specification, in which in a somewhat schematic manner and simply as an example, the prefered details of the invention are represented.

Figure 5:
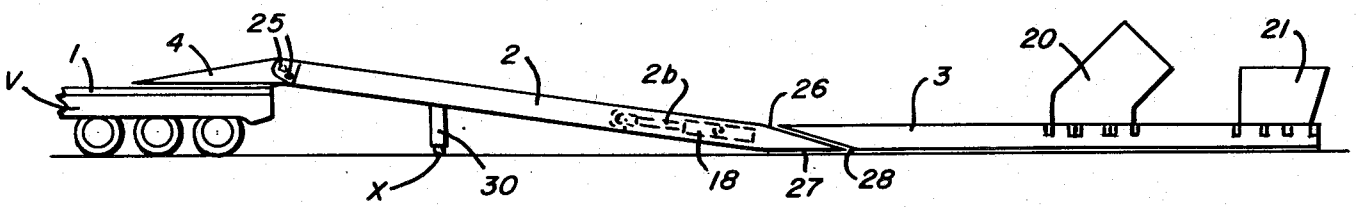
FIG. 5 is a view just like FIGS. 2, 3, and 4, representing the platform ramp unit in a third stage of spreading out.

With regard to said illustrations and in accordance with the same, features, parts, mechanisms and functions of them will be described. In accordance with FIG. 2, the loading and unloading platform or ramp unit for heavy self-propelled material is closely mounted upon a railroad flat car preferably a MMI type wagon -V-. Upon this car -V- a first or stationary platform portion -1- (FIGS. 1 and 2) has been solidly connected and upon said stationary platform portion there is a second or middle platform portion -2- and superposed upon the latter is a third or protection platform portion -3-. This telescoped or contracted arrangement (FIG. 2) is the one for transportation. The spread out or extended arrangement (FIGS. 1 and 5) is the working arrangement or the one for loading and unloading of the train by the platform or ramp unit. In accordance with the respresentation of FIG. 1, the second or middle platform portion -2- is hinged on the head end with the wedge sections -4-. Between both wedge sections -4- there is a space -5-. In said space -5- the mechanisms of the platform or ramp unit specified as follows are, substantially, included: a driving element engine -6- having a hydraulic pump; a capstan or winch -12- driven either hydraulically or directly from the engine -6- and a hydraulic distributor or valve arrangement -16- with different handles or controls -17-.

The engine -6- has a transmission shaft -7- provided with cog wheels -8- on each end in order to activate a traction chain -10- that move the traction wheels -9-. The transmission shaft -7- may be directly or hydraulically driven from the engine. The set of wheels -9- are mounted on the middle platform portion below the surface of the wedges -4-, and they slide on guides -1*a*- made in the stationary platform portion -1-.

Another set of wheels 9*a*- in line with the traction wheels -9- also slide on the guides -1*a*- and they serve to stabilize the middle platform portion -2-. The set of little rollers -15- is also mounted below the wedge sections -4- on a shaft parallel to the traction wheels -9- but slightly advanced or forwardly thereof. This set of little rollers -15- slides in unison with the traction wheels -9- on some parallel guides -1*b*- also provided on the stationary platform portion -1-. The middle platform portion -2- near the front end is equipped on the side with some telescopic, verticalizable and sliding skids -18- for support and guiding and advance of the platform in the first stage of its open spreading out. Lined up with the skids -18- the middle platform portion -2- is equipped with a prop or stay -30- (FIG. 4) which serves to reinforce the stiffness of the middle platform portion -2- when it is extended in the loading and unloading tasks. The engine -6- by means of a clutch mechanism or hydraulically drives the transmission -11- of the capstan or winch -12-; and end of the winch cable -13- is coupled in a ring -14- on the protection platform portion -3-.

A set of wheels -19- mounted on the head below the protection platform roll upon the guides -2*a*- of the middle platform portion -2-.

The protection platform portion -3- is provided with two side fenders or access and descent ramps -20- which are raised or collapsed by means of a double set of hydraulic clinders -22- operated from the distributor or valve arrangement -16- and controls -17-. This same protection platform portion -3- is provided with two other cornered, front fenders or access and descent ramps -21- each driven by a single hydraulic cylinder -23- also operated from the distributor or valve arrangement -16- and controls -17-.

In another example of a design the fenders or access and descent ramps -21- can be independent, in other words, the front one of the corners can, in the same fashion, be driven independently. Of course, the raised or lifted position of the fenders or access and descent ramps -20- and -21- corresponds to the transportation position and the collapsed or lowered position to the loading and unloading position forming access and descent ramps with a slight difference of level but covering and protecting the rails -R- the ties -T- and the ballast -B- of the railway line.

The protection platform portion -3- is equipped with a set of four jacks -24- that pass vertically and that are operated by hand in order to anchor the protection platform portion -3- against the rails -R- themselves when it is spread out (FIG. 1) preventing it from tilting or pitching sideways in the loading and unloading tasks.

Figure 6:
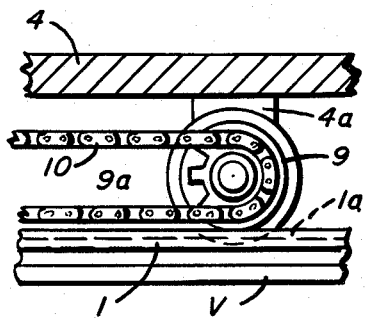
FIG. 6 is an elevational view of one of the traction wheels of the second or middle platform ramp portion.
Figure 7:
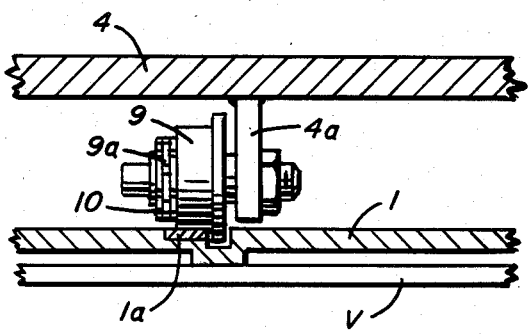
FIG. 7 is a side view of said traction wheel.

FIGS. 6 and 7 show an ample detailed view of the traction wheels -9- that concentrically consist of a crown or sprocket -9*b*- driven by the traction chain -10-. It is mounted on the girder -4*a*of the wedge -4- or head of the second or middle platform ramp portion -2-. The traction wheels -9- roll along the guides -1*a*- made up of a line or strip of friction material -1*a*1-, and channel -1*a*2- for the use of a wheel -9- with a flange.

Figure 8:
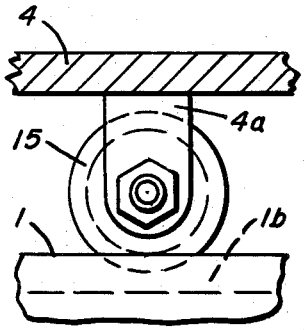
FIG. 8 is an elevational view of a little wheel with a limited run for the sliding of the second or middle platform ramp portion.
Figure 9:
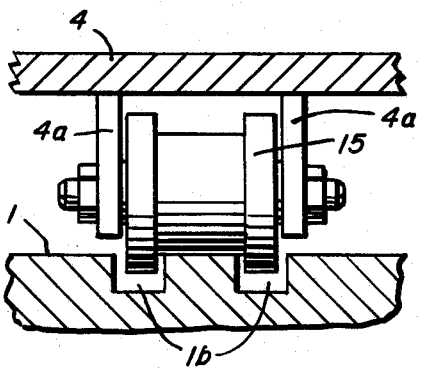
FIG. 9 is a side view of the previous little wheel.
Figure 10:
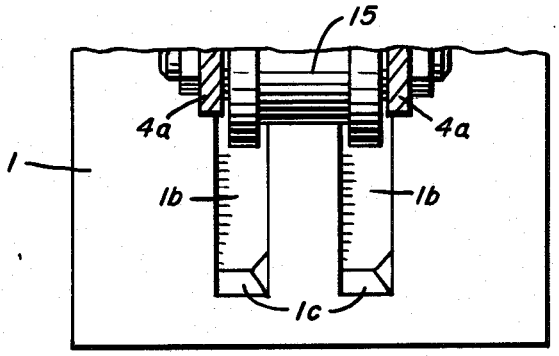
FIG. 10 is a partial plan view of FIG. 9.

FIGS. 8, 9 and 10 show the little roller -15- grooved and mounted between the girders -4*a*- of said wedge -4- on a shaft parallel but advanced forwardly in terms of the shaft of the traction wheels -9-. The little rollers slide along the double channel lines of the parallel girder -1*b*- that are, at least, on one end, depending on the direction of lead or advance of said little rollers, closed by the stops -1*c*-. In the way the middle platform portion -2- has a limited displacement or run. When the little rollers -15- are braked in the stops -1*c*- the traction wheels, a little bit behind, also remain inside the stationary platform portion -1-.

Figure 11:
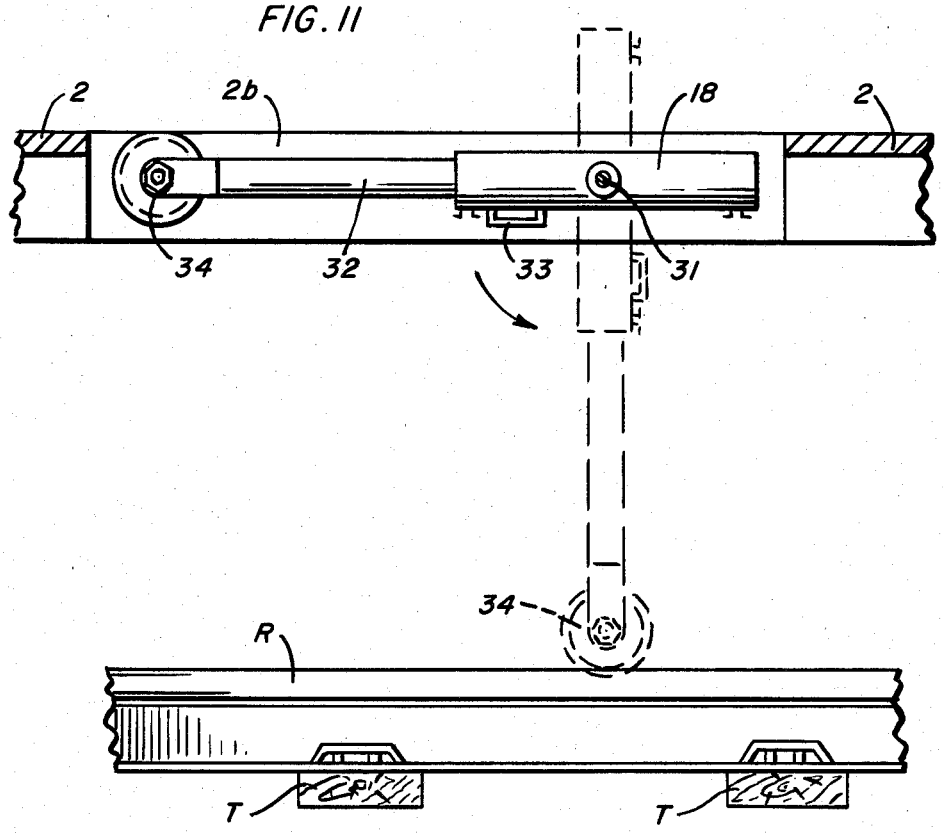
FIG. 11 is an elevational view of one of the skids for the first stage of spreading out (FIG. 3) in two positions, retracted in the one of the unbroken line and extended out in the one of broken lines.
Figure 12:
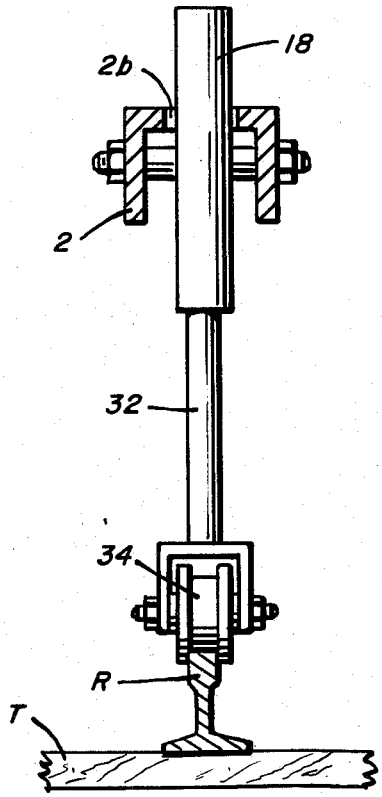
FIG. 12 is a side view of the previous skid in an extended out position.

The skids -18- (FIGS. 11 and 12) in the collapsed or folded position, remain within a groove -2*b*- open above and below in the middle portion portion -2- and fastened by an appropriate means. The skids -18- are hinged on the side to pivots -31- that make it possible for the skids -18- to turn no less than 90°. The skid -18- is also a telescopic body, for example, a hydraulic cylinder provided with a piston -32- provided with a grooved wheel -34- on its free end.

Figure 3:
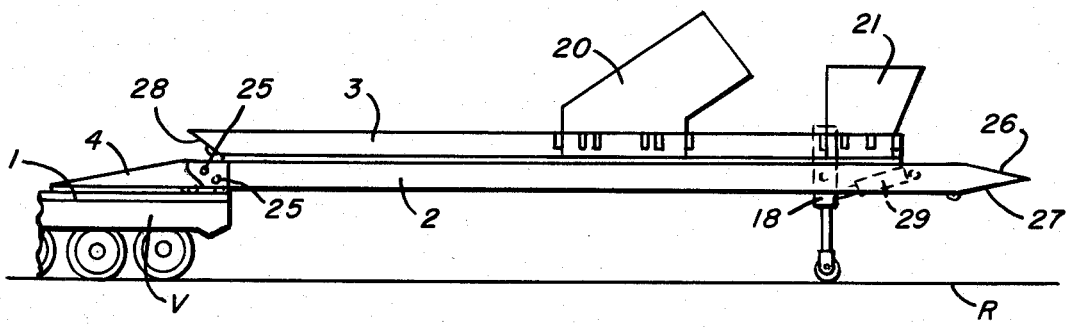
FIG. 3 is a view jusst like the previous one representing the platform ramp unit in a first stage of spreading out.

This skid -18- can be pivoted out of the platform portion -2- by hand by means of a handle -33- and made rigid by means of a pivoted rigid brace, a tensile brace or another one not represented, and hydraulically extended or telescoped as needed. The opening or closing of the skid -18- may also, optionally, by made automatic by means of a second piston -29- (FIG. 3).

Figure 13:
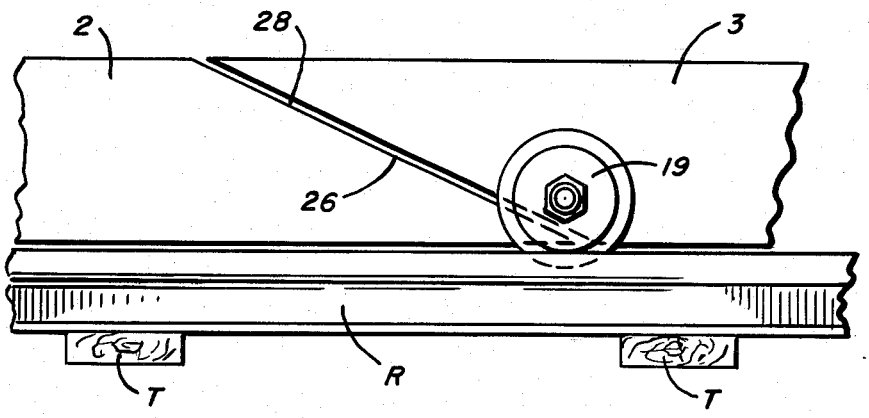
FIG. 13 is a partially sectioned view of the second or middle and the third or protection platform portions represented in an elevational view of one of the wheels for the sliding of the protection platform portion.
Figure 14:
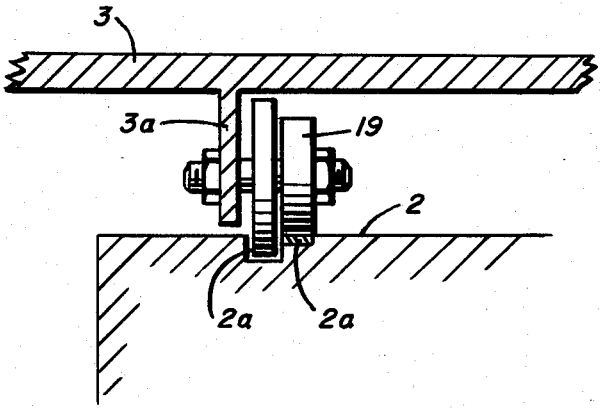
FIG. 14 is a partially sectioned side view of the previous wheel.

FIGS. 13 and 14, show the wheels -19- of the protection platform portion -3- that are installed in the head of said platform portion, concretely in a section but below into a bevel -28- that, in the spreading out of the platform, always remains in contact also resting upon, a superior beveled section -26- of the middle platform portion -2- until its edge reaches the grooved guide -2*a*- of said platform portion upon which the running elements wheels -19- run.

Figure 15:
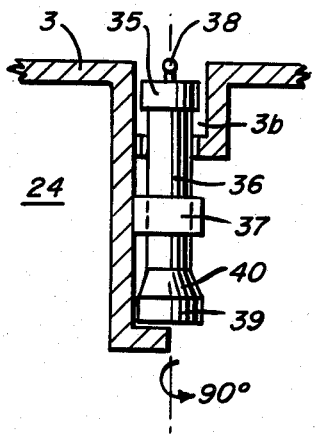
FIG. 15 is an elevational end view and one in the stage of rest of one of the anchoring bed-plates of the protection platform portion.
Figure 16:
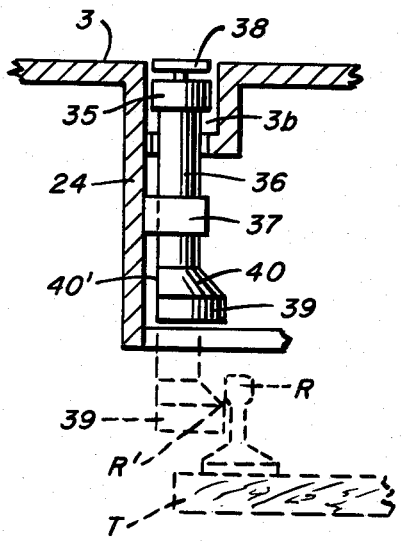
FIG. 16 is a side elevational view in the operative state of the aforementioned bed-plate.

The jacks -24- that immobolize the protection platform portion -3- are represented in FIGS. 15 and 16. Said jacks each include a cyclindrical rod -36- provided with a head -35- of a larger diameter that are housed in grooves -3*b*- in the platform portion -3-. The rods -36- are guided on flanges -37- and are finished off in some ecentric bed-plates -39- that have a bevel-edged step -40- on one side and in the opposite side a flat area -40'- on the surface of the bed-plates -39- of the cylinder rod -36-. In the upper part it has a T-shaped cross-piece -38-. By means of this cross-piece -38- the jack -24- may be operated. By turning it more than 90° and clearing the lower end of the jack -24- the rod -37- drops and by turning it, the bed-plate -39- adjusts itself against the offset or web -R'- of the rail -R- fastening the platform portion -3- to the rails -R-.

Figure 17:
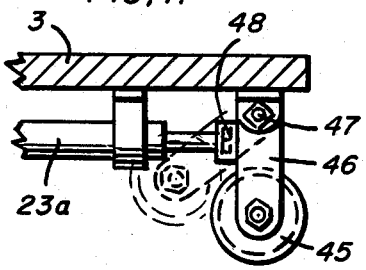
FIG. 17 is a side elevational view of the front, retractable grooved wheels of the protection platform portion.
Figure 18:
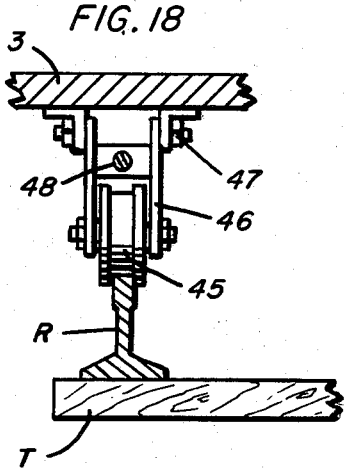
FIG. 18 is an elevational end view of the previous wheel.

The grooved wheels -45- (FIGS. 17 and 18) are mounted on the front part of the protective platform portion -3- below the corner or front fenders -21- by means of a hinged fork -46- and provided with a bridge -48- to which the piston -23*a*- is fastened which spreads it out or collapses it depending on what is necessary.

Figure 19:
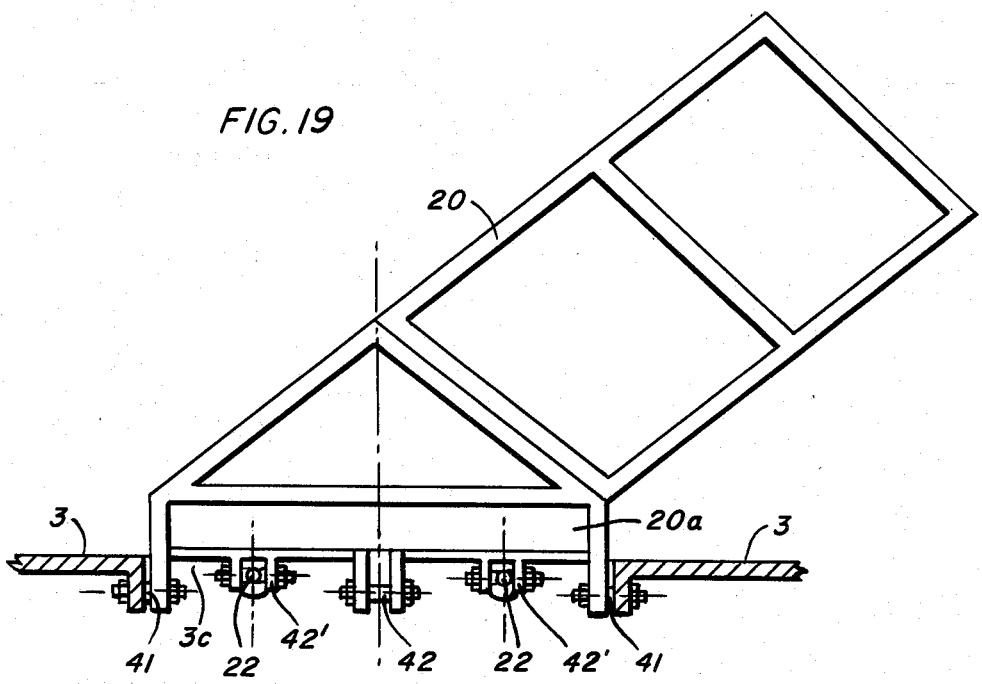
FIG. 19 is an elevational end view of one of the side fenders or access and descent ramps in a raised position.

The side fenders -20- have the shape of a parallelogram which when collapsed form side ramps with a slight difference of level oriented sideways and backwards. They consist of a head -20*a*- (FIG. 19) bent 120° and coupled in a gap -3*c*- of the protective platform portion -3-. It is provided with center tongues and on the ends in order to form articulation hinges -41- and -42- and, between these, joining points -42'- for the pistons -22- that order the movements for the collapsing or raising of the fenders or ramp section -20-.

Figure 20:
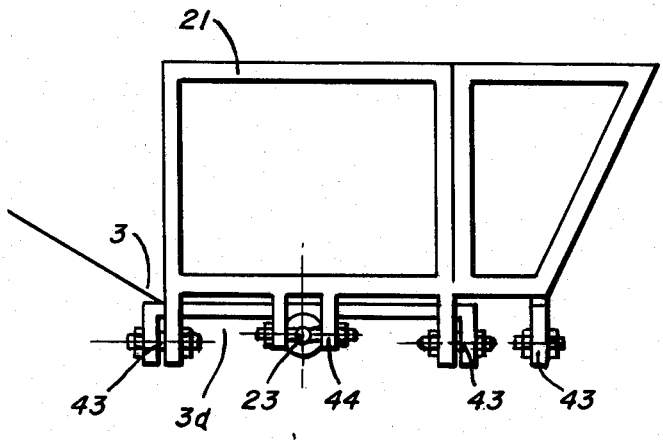
FIG. 20 is an elevational end view of one of the front fenders of access and descent ramps in a raised position.

The fenders -21- have combined rectangular and trapezoidal shaped bodies; or else there are two bodies each one with one of said shapes, the first part adpated to the bevel -3*d*- (FIG. 20) of the protection platform portion -3- and the other one to the foot or rear of said -3-. Just like the previous fenders, the latter has tongues in order to form articulations -43- and a joining lug -44- for the piston -23-.

Figure 2:
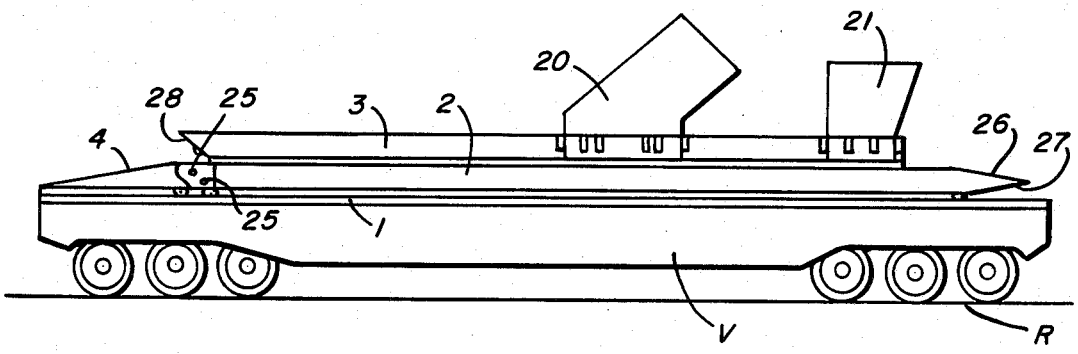
FIG. 2 is a schematized elevational side view of a railway flat car equipped with the platform in a transporting position.

In accordance with the description made and the illustrations the platform unit operates as follows:

Starting from the structure of the platform unit proposed for the invention in its state of transportation represented in FIG. 2, the ramp or platform unit will be mounted on a car coupled to the head or rear of the convoy train in order to be loaded and unloaded from the front to the back as well as vice versa.

The flat car brakes are locked or otherwise properly wedged up to the track.

The engine -6- (FIG. 1) is started up in order to send hydraulic pressure to the entire circuit. At the same time it will activate the traction wheels -9-, slowly, making the entire superposed structure of the second and third platform portions move forward along the guides -1*a*- the structure departing past the bevels -26-, -27- of the platform portion -2-.

Said platform portion -2- having moved forward a sufficient distance that the skids -18- (FIG 3), with spread out telescopic piston -32-, drops so that the wheel -34- (FIGS. 11 and 12) rests on the rail -R-; in this manner the platform moves further forward until the little rollers come up against the terminals or stops -1*c*- of the guides -1*b*- (FIGS. 8, 9 and 10).

Figure 4:
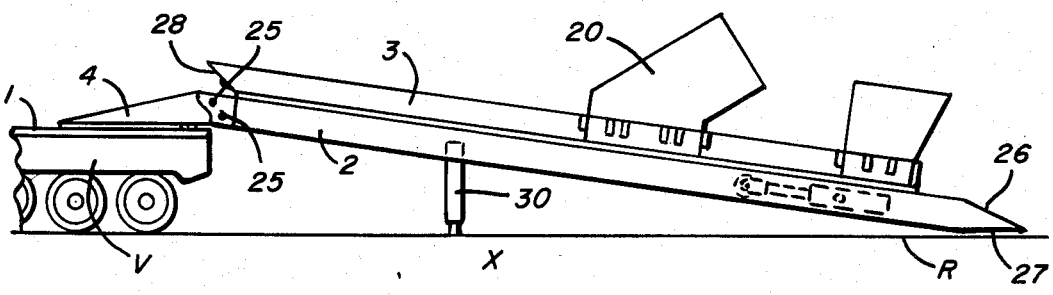
FIG. 4 is a view identical to FIGS. 2 and 3 representing the platform ramp unit in a second stage of spreading out.

In this position the skids -18- are telescoped and withdrawn collapsing them inside the platform portion -2- and lowering the free end of the platform portion -2- (FIG. 4) (while the wheel -34- is still in contact with the rail -R-), in such a way that the platform portion -2- hinges in -25- forming the ramp in FIG. 4. Afterwards the prop -30- spreads out. Then the winch -12- is set loose permitting the protective platform portions -3- to slip downwardly until in the fully extended position guided by the wheels -19- that run on the guides -2*a*- of the platform portion -2- until they rest on the line (FIG. 5) that runs on the rails upon the wheels -45- previously spread out by -23*a*-. In this position the wheels -19- remain resting on the guides -2*a*- on the bevel -26- of the platform portion -2- (FIGS. 13 and 14).

Then the jacks -24-, obviously in the resting position, turn in such a way that they drop clearing the stop that retains them and anchors them in the rails -R- (FIG. 16) fastening or immobilizing the platform portion -3-.

Finally the cylinders -22- and -23- are activated collapsing or lowering the fenders or ramp sections -20- and -21- that will form end and side access and descent ramps with a slight incline (FIG. 1) protecting the rails, the ties and the ballast and that will allow for easy access of the self-propelled heavy material that is desired to be loaded and unloaded.

Having completed the operation, the platform unit folds up by proceding in the opposite manner.

The engine -6- is started up in order to again send pressure to the hydraulic circuit if double acting cylinders are used or hydraulic reversal of direction to return fluid to a reservoir, pumping it out of the cylinder if single acting cylinders are used. The fenders -20- and -21- are raised; the jacks -24- are released; the flat wagon -3- is recovered by means of the cable -13- and the winch -12- that are coupled in ring -14; the skids -18- are partially raised and their wheel -34-, remaining in contact with the rail helping the towing of the platform. In an appropriate position the skids -18- are fully collapsed and by means of the traction wheels -9- the platform portions are still hauled and so is the rest that is superposed to it. In an appropriate position the structure is anchored to the flat car by means of conventional connectors not represented.

Once the nature of the invention has been conveniently described, for the opportune effects it is declared that the same does not remain restricted to the exact details described here, but rather, on the contrary, all the modifications that are considered to be opportune will be introdued in it, as long as they do not alter the essential features of the same that are claimed as follows.

I claim:

1. A loading ramp system for railway flat cars and the like comprising a generally stationary base portion mounted on said flat car, guide means mounted on said base extending generally longitudinally thereof, an extendable ramp movably supported on said guide means and said base for longitudinal displacement between extended and retracted positions including pivot means carried by said ramp configured to permit said ramp to swing angularly downwardly when in an extended position to angularly engage a surface therebeneath, a platform carried by said ramp in stacked relation and extensible relative thereto along said surface to define a generally parallel transitional surface overlying the rail bed when in extended relation with respect to said ramp, said platform including at least one pivotally attached apron movable between a folded and an extended position laterally of the platform, said apron carried by and angularly related to the plaform when extended to define bridge means for loading and unloading cargo from said flat car, said ramp, and said platform onto said apron and thereby to and from a position displaced laterally from said railway bed to avoid damage thereto during loading and unloading operations.

2. A loading ramp system in accordance with claim 1 wherein said guide means comprises inner and outer pairs of guide rails arranged in parallel relation, said inside parallel pair configured to accommodate simple single flanged wheel rollers and said outside parallel pair is configured to accommodate grooved double flanged rollers.

3. A loading ramp system in accordance with claim 2 wherein at least the end of said parallel guides, in the forward direction, includes means defining a stop to limit the extension and retraction of said ramp.

4. In a loading ramp system as defined in claim 1 wherein said ramp includes a beveled end configured to engage said surface on one face and to engage said platform on its opposite face.

5. A loading ramp system as defined in claim 1 characterized by the fact that each said apron is pivotally mounted in recesses formed on the side edges of the platform.

6. A loading ramp system as defined in claim 1 further including means of articulation for each said apron to move said apron between positions.

7. A loading ramp system as defined in claim 6 wherein said means of articulation are hydraulic cylinders mounted below said platform.

* * * * *